US005653067A

United States Patent [19]

Lago

[11] Patent Number: 5,653,067

[45] Date of Patent: Aug. 5, 1997

[54] ROOFING SYSTEM COMPRISING TILES ALTERNATING WITH ROOFING BEAM MEMBERS

[75] Inventor: Alberto Dal Lago, Milan, Italy

[73] Assignee: DLC S.r.l., Milan, Italy

[21] Appl. No.: 601,254

[22] Filed: Feb. 14, 1996

[30] Foreign Application Priority Data

Feb. 17, 1995 [IT] Italy ..... MI95A0289

[51] Int. Cl.[6] ..... E04B 7/12; E04C 2/26

[52] U.S. Cl. ..... 52/90.1; 52/18; 52/250; 52/200; 52/13

[58] Field of Search ..... 52/18, 250, 200, 52/90.1, 13, 14

[56] References Cited

U.S. PATENT DOCUMENTS

| | | | |
|---|---|---|---|
| 1,197,716 | 9/1916 | Dingman | 52/18 |
| 2,687,102 | 8/1954 | Rongved et al. | 52/18 X |
| 2,705,929 | 4/1955 | Atkins | 52/18 |
| 2,746,283 | 5/1956 | Abrams | 52/250 X |
| 3,289,360 | 12/1966 | Gartner | 52/13 X |
| 3,299,585 | 1/1967 | Wilkins | 52/13 |
| 3,304,506 | 7/1968 | Thompson | 52/13 |
| 3,788,014 | 1/1974 | Semisch | 52/18 |
| 3,978,635 | 9/1976 | Theault | 52/18 X |
| 4,395,853 | 8/1983 | Lemaitre | 52/18 |
| 4,671,025 | 6/1987 | Butler | 52/18 |
| 5,197,238 | 3/1993 | Peleg | 52/13 |

FOREIGN PATENT DOCUMENTS

| | | |
|---|---|---|
| 0250020 | 12/1987 | European Pat. Off. . |
| 0521431 | 7/1993 | European Pat. Off. . |
| 2654134 | 5/1991 | France . |
| 2668192 | 4/1992 | France . |

*Primary Examiner*—Wynn E. Wood

*Attorney, Agent, or Firm*—Hedman, Gibson & Costigan, P.C.

[57] ABSTRACT

A roofing system for industrial buildings is based on a plurality of self-supporting tiles (10), prefabricated from reinforced concrete, having a generally "V"-shaped cross-section, wherein the wings (11) of the "V"-shaped cross-section extend from a longitudinal channel (14) designed to collect rain water, and in which the tile (10) ends, at its opposite ends, with respective closure heads (12) each of which is provided with a support block (15), which is designed to rest on a supporting carrier beam (16). The support block (15) is furthermore provided with protruding parts (18) designed to support the corresponding block (15) of a superimposed identical tile (10), with between pairs of tiles (10) skylight-roofing beam members and shed-roofing beam members being intercalated.

4 Claims, 8 Drawing Sheets

ROOFING SYSTEM COMPRISING TILES ALTERNATING WITH ROOFING BEAM MEMBERS

The present invention relates to a roofing system comprising a plurality of self-supporting tiles, prefabricated from reinforced concrete, and skylight-roofing beam members and/or shed-roofing beam members being intercalated between said tiles.

The general purpose of the instant invention is of providing a roofing system for industrial buildings which, besides showing a high level of reliability, also has a high finishing level on both extrados, as well as intrados, sides.

More precisely, the purpose of the present invention is of providing a roofing system capable of meeting the following requirements:

- displaying at its extrados side a waterproofing layer which can be applied at the manufacturing factory, so as to secure a perfect waterproofing and rain water flowing towards drain channels which convey it to the outside, at pillars equipped with downpipes;
- showing at its intrados side a concrete finish attained by means of metal formworks, so that, without any further treatments, not even painting treatments, the resulting ceiling results to be finished, with tiles which are finished at both intrados and extrados sides;
- by means of daylight-roofing beam members and shed-roofing beam members, securing the highest flexibility in the choice of the lighting rates and types;
- being so configured as to have the highest static efficiency;
- being so configured as to display the highest storage and transport efficiency, with the several elements being capable of being piled upon each other, to form storage/transport stacks;
- being so configured as to be suitable for being manufactured by moulding with moulds capable of securing the highest finishing degree on both surfaces.

The above purposes are achieved, according to the present invention, by a roofing system which is characterized in that it comprises, in combination: a plurality of self-supporting tiles, prefabricated from reinforced concrete, displaying a generally "V"-shaped cross-section, wherein the wings of the "V"-shaped cross-section extend from a longitudinal channel designed to collect rain water, and in which said tile ends, at its opposite ends, with respective closure heads at each of which a support block is provided, which is designed to rest on a supporting carrier beam. Said support block is furthermore provided with protruding parts designed to support a corresponding block of a superimposed identical roofing element, with between pairs of said tiles skylight-roofing beam members and shed-roofing beam members being intercalated.

The structural and functional characteristics of the present invention and the advantages thereof as compared to the prior art will be better understood from the following disclosure made by referring to the accompanying schematic drawings, which display exemplifying embodiments of the same invention.

Figure 2:
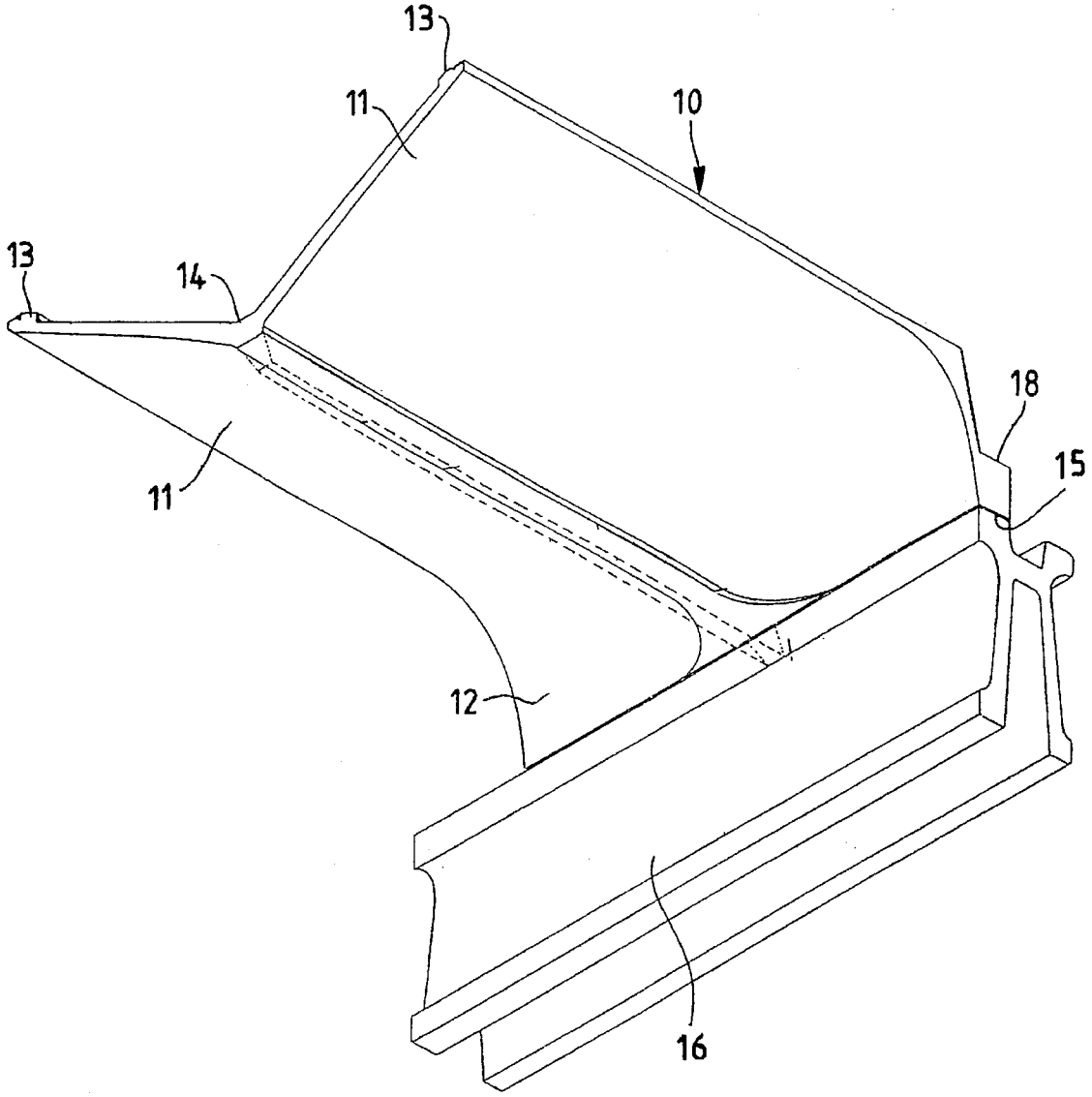
FIG. 2 shows a perspective bottom view partially illustrating the tile according to the present invention.
Figure 3:
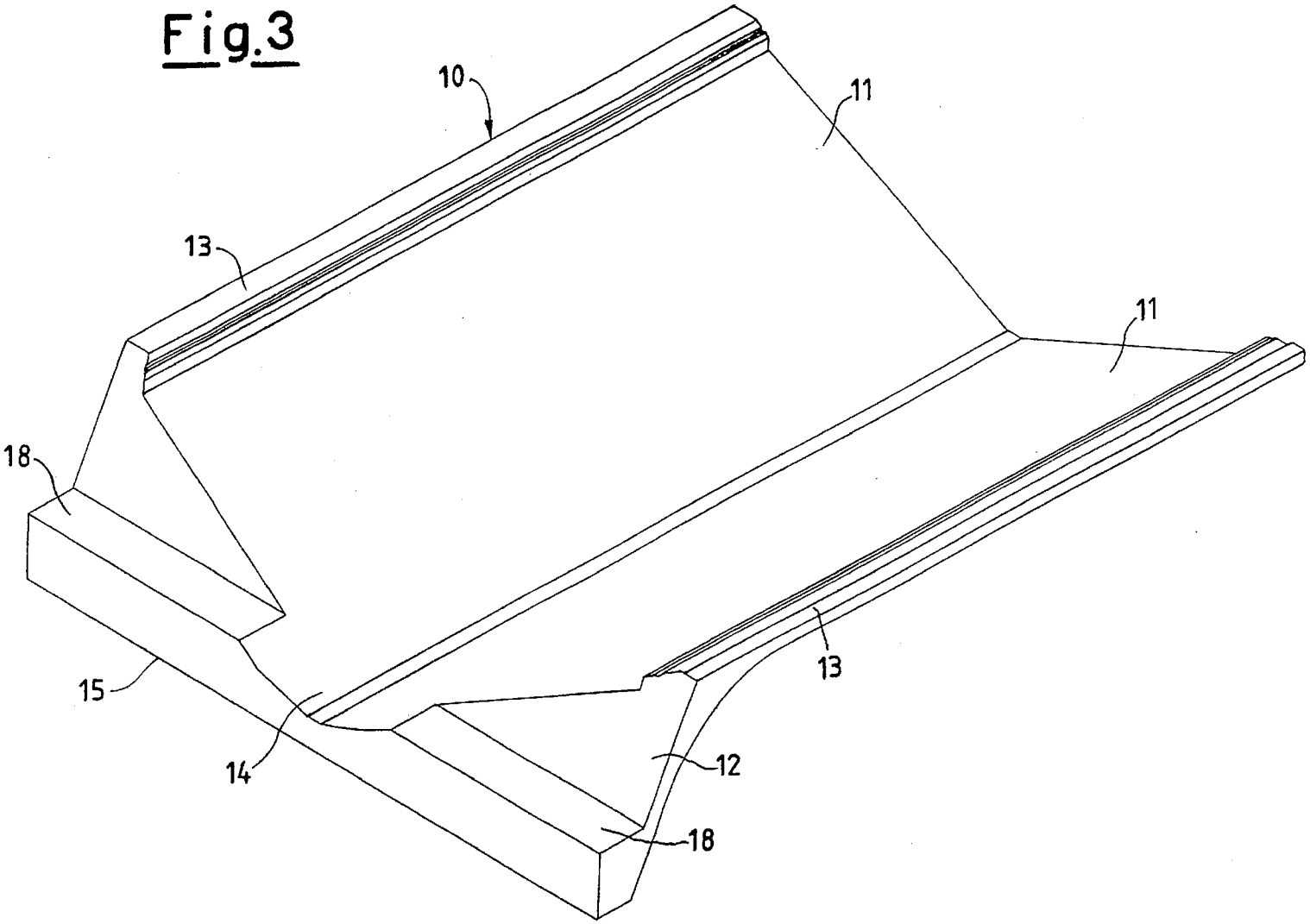
FIG. 3 shows a perspective top view illustrating the same tile as of FIG. 2.
Figure 4:
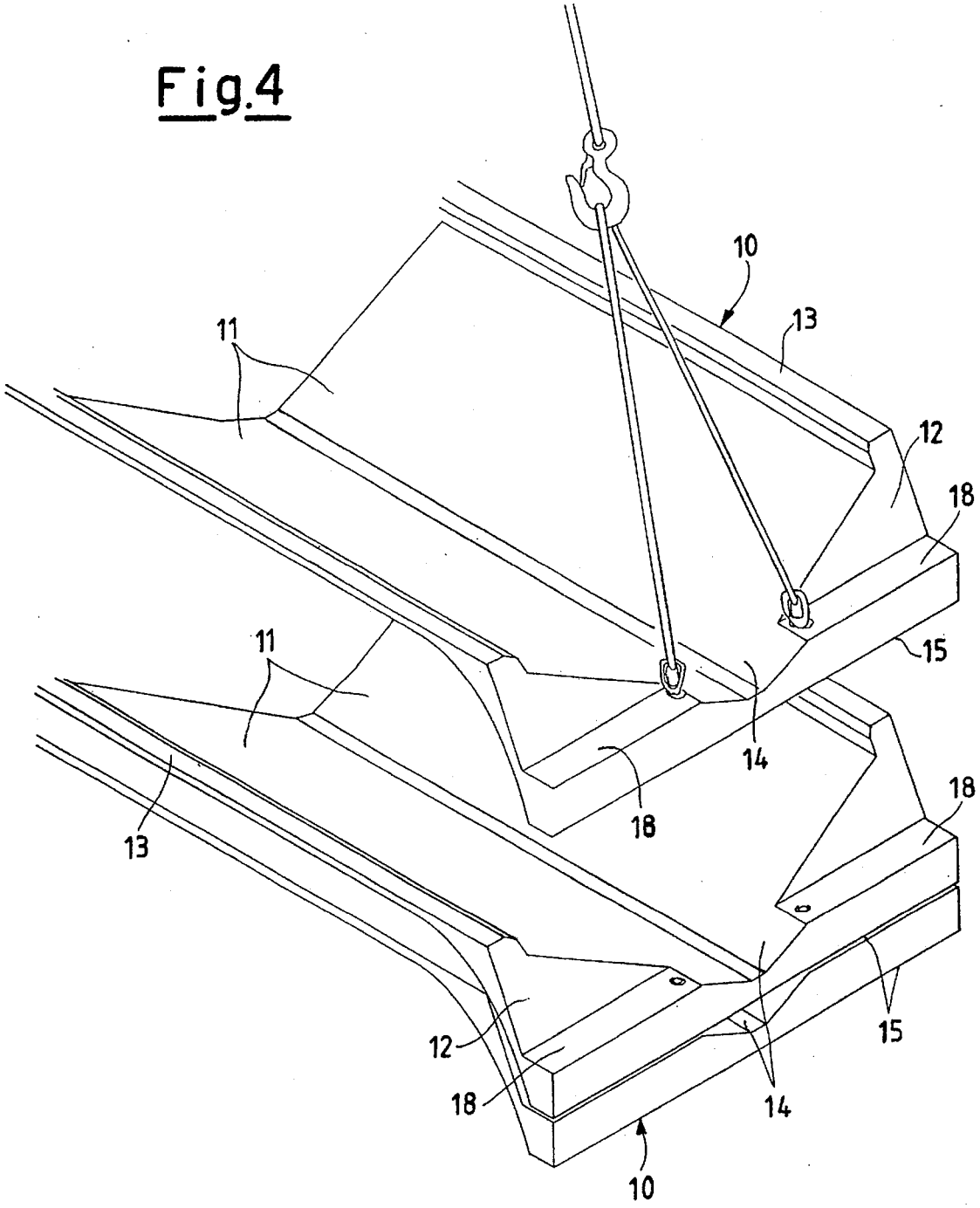
FIG. 4 shows a perspective view illustrating the possibility of piling a plurality of tiles according to the present invention upon each other.
Figure 5:
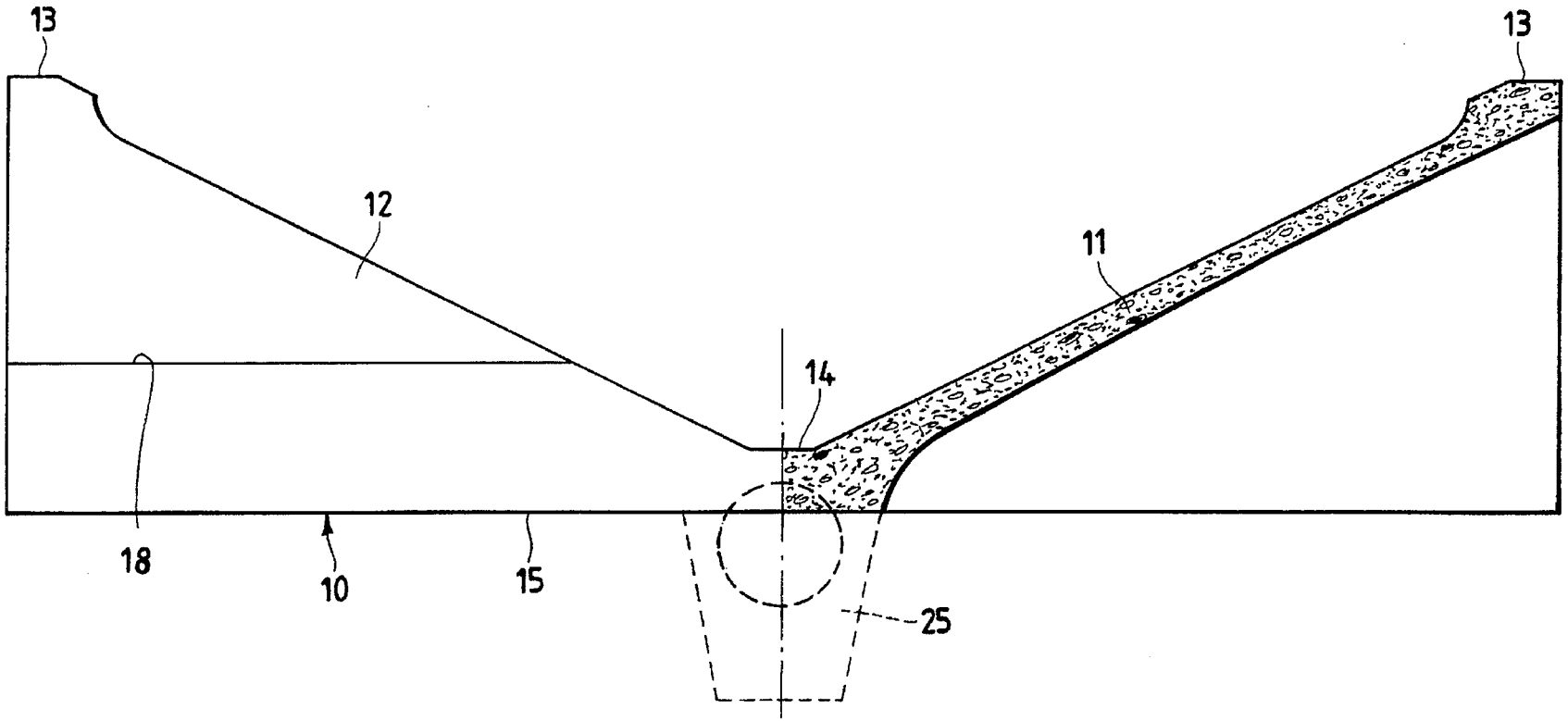
FIG. 5 shows a partially sectional, partially elevation view of the tile according to the present invention.

Referring to FIGS. 2–4 of the accompanying drawings, the tile according to the present invention is generally indicated with (10) and is constituted by a self-supporting, prefabricated member of reinforced concrete having a substantially "V"-shaped cross-section with wings (11) which, according to a characteristic feature, end, at their opposite ends, with heads (12) and are externally provided with longitudinal ribs (13).

A central longitudinal channel designed to collect rain water is indicated with (14).

Figure 1:
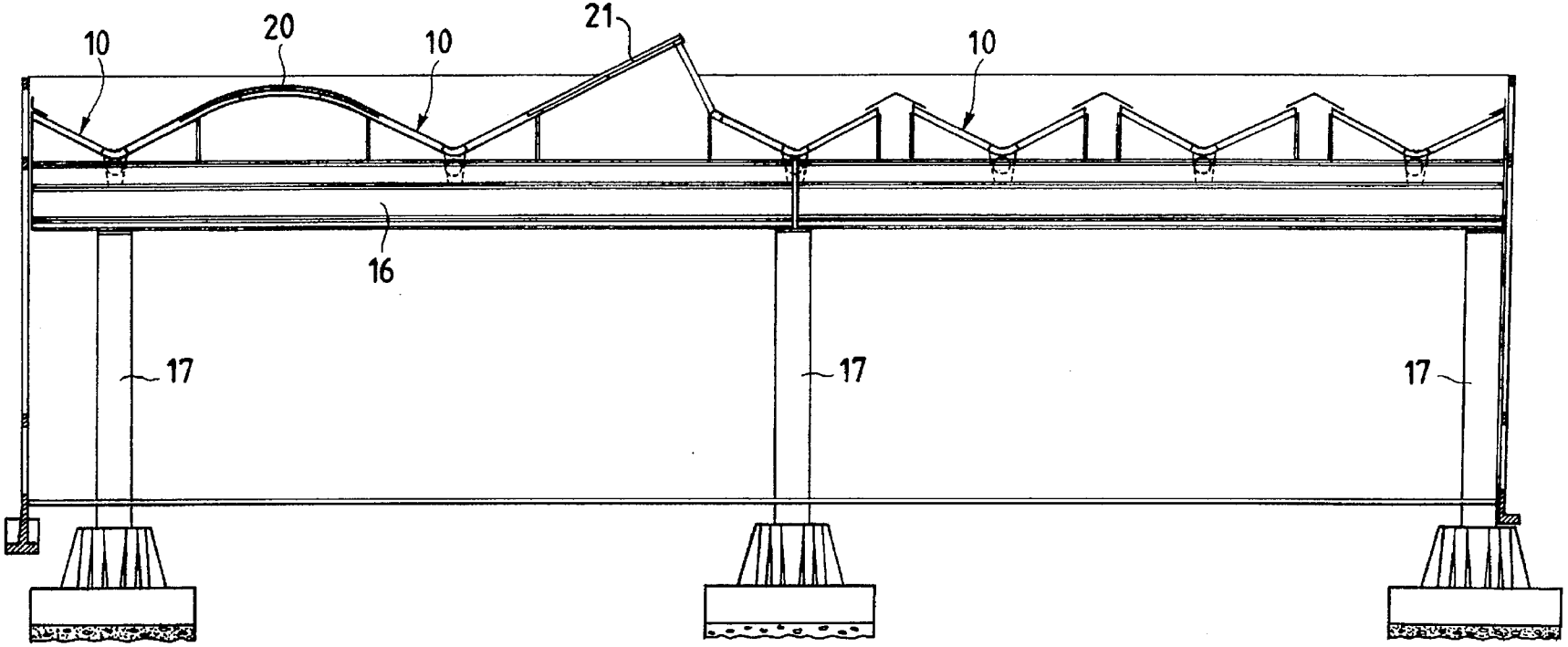
FIG. 1 shows a schematic view illustrating the roofing system according to the present invention.

As one will clearly see from FIGS. 2–4 of the drawings, the heads (12) are each provided with a straight block (15) designed to rest on a supporting carrier beam with "H"-shaped cross-section (16), which, in its turn, is supported by pillars (17) (FIG. 1).

Said block (15) furthermore shows two pairs of side protruding parts (18) which are designed to act as a carrier means for said block (15) when a plurality of tiles (10) are piled upon each other to form a stack as displayed in FIG. (4) and, at the same time, in order to keep stacked tiles properly spaced apart from each other, to prevent the weight of tiles from being applied to lower tiles in the stack.

Furthermore, inside the protruding parts (18) lifting eyebolts are embedded, to be used for lifting the tile.

By using the above disclosed tile (10), several types of different roofing systems can be realized by intercalating skylight-roofing beam members (20) and shed-roofing beam members (21) between pairs of suitably spaced apart tiles (FIG. 1).

Rain water collected in the central channel (14) flows to the opposite ends of the tile and is collected in the upper channel of the "H"-beams (16), which drain it through downpipes embedded inside the pillars (17) of the structure.

Figure 7:
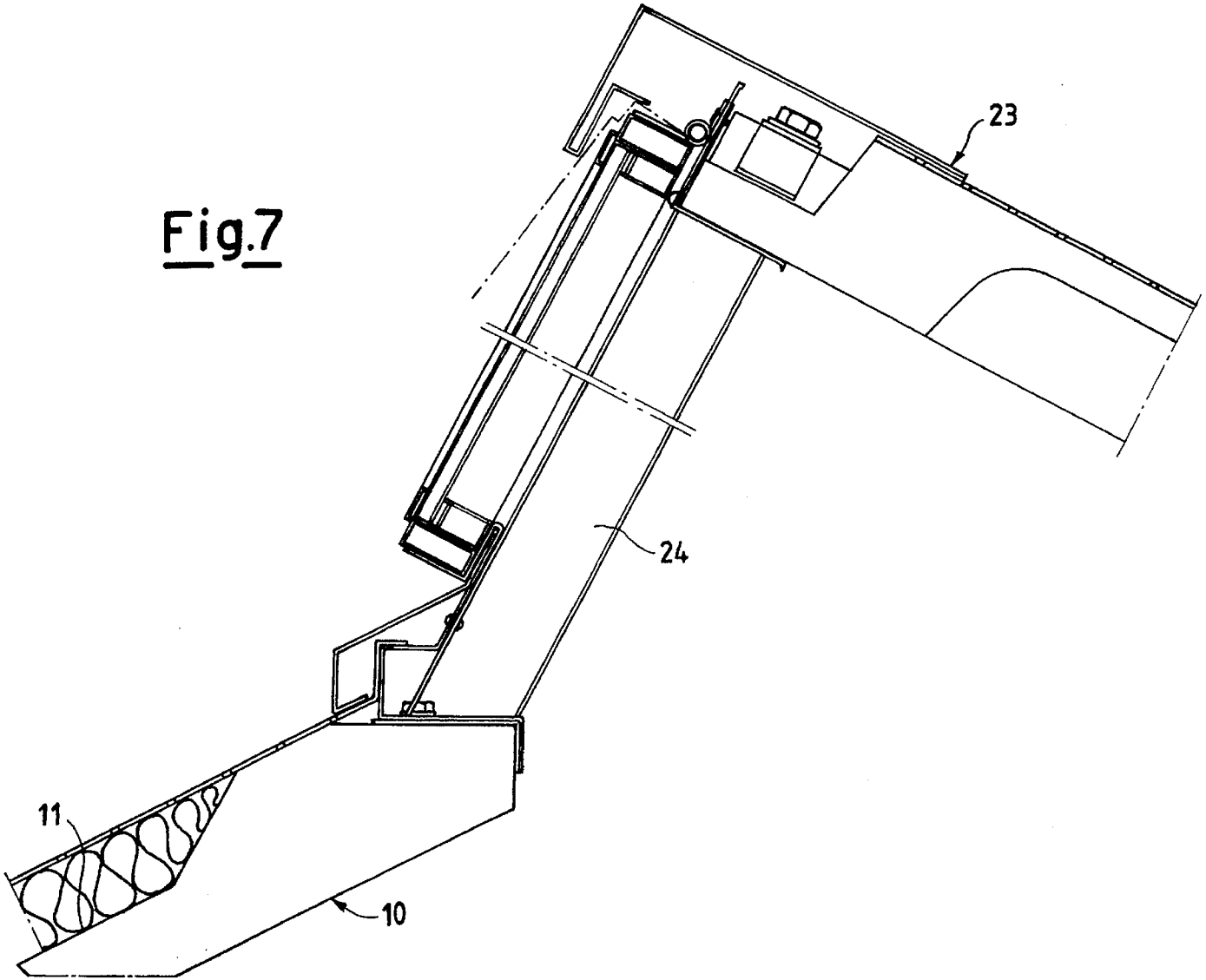
FIG. 7 shows a cross-section illustrating the shed-window module.

In FIG. 7, the numeral (23) indicates a shed-window module which is self-supporting and is assembled at the building yard.

Said module (23) comprises a window (24) stably fastened to a roofing beam member (21).

The window (24) is coupled with, and fastened to, the edge of the wing (11) of a tile (10), and the roofing beam member (21) is coupled with, and fastened to, the edge of a further tile (10) installed spaced apart from, and parallel to, the first one.

Figure 8:
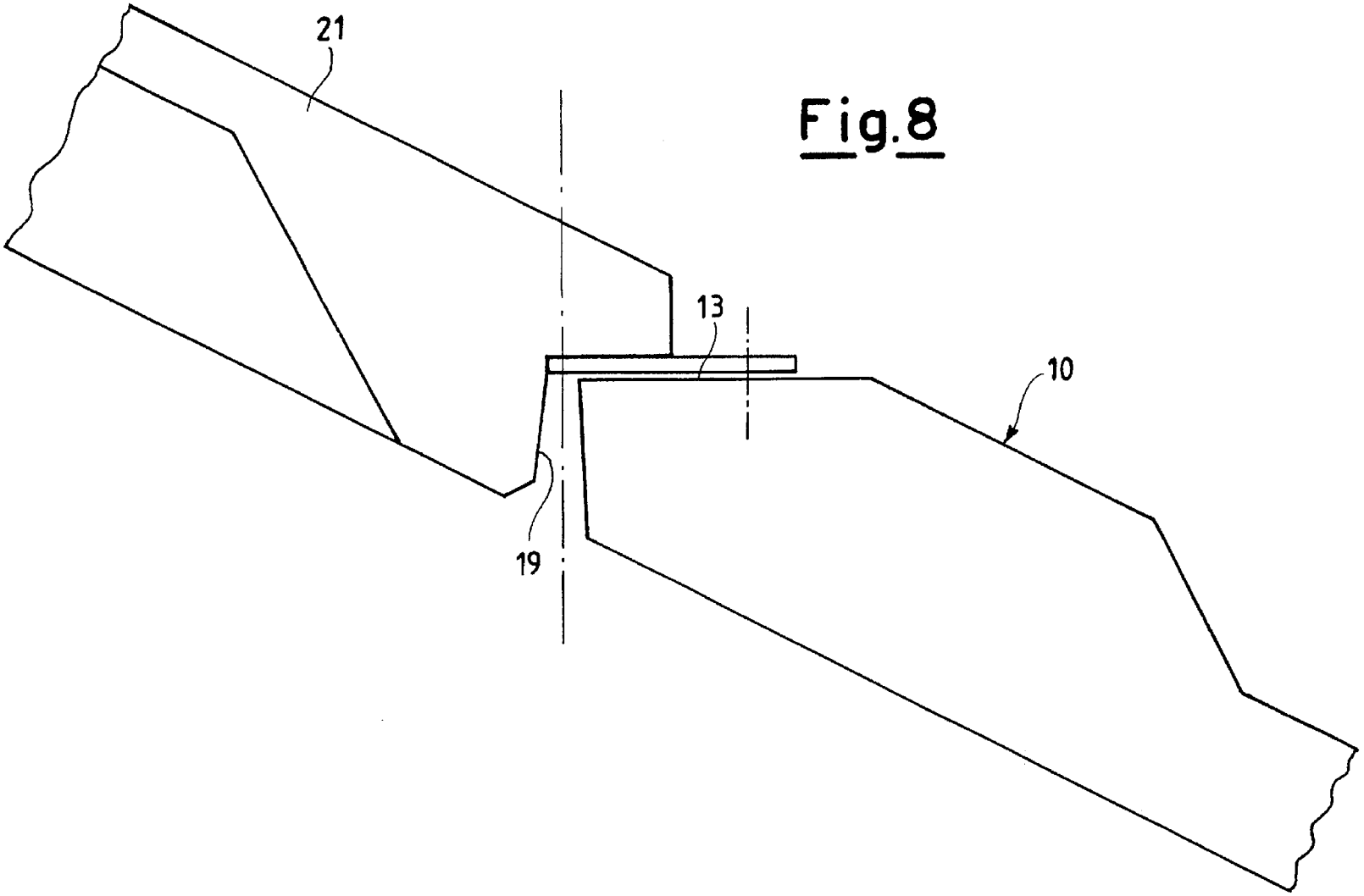
FIG. 8 shows an enlarged detail illustrating the tile-roofing beam member coupling.

For that purpose, as one will clearly see from FIG. 8 of the drawings, the mutual coupling of tile and roofing beam member is accomplished thanks to the contoured ribs (13) of the tile (10) which get coupled with a complementary seat (19) provided in the roofing beam members (21).

In that way a perfectly finished, continuous planar surface is provided on both the extrados and intrados sides.

Figure 6:
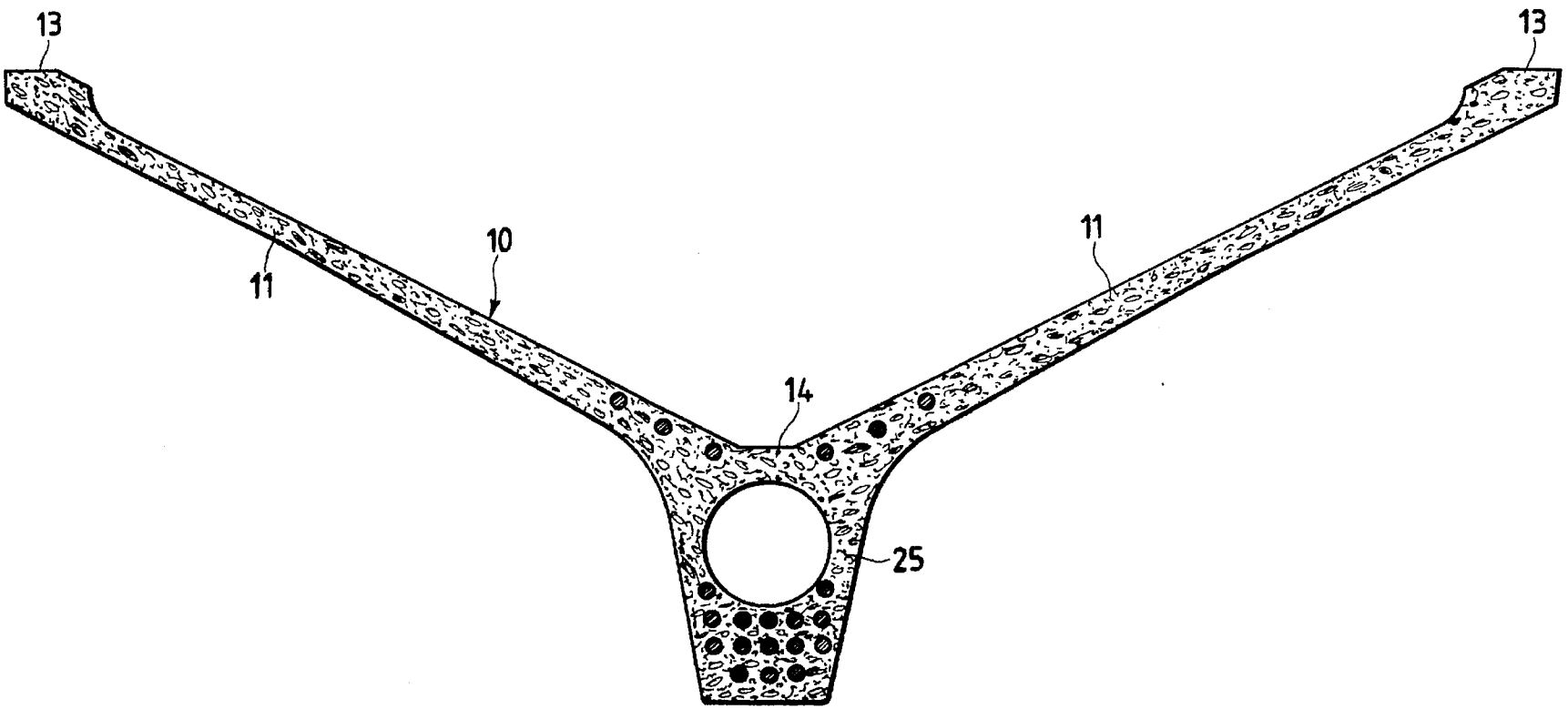
FIG. 6 shows a transversal cross section of the tile according to the present invention provided with an additional rib in order to vary the span of the tile (up to a 30 meter span)

FIG. 6 displays a modified tile (10) with an additional central rib (25) providing additional structural support to enable an increase in the span of said tile, up to 30 meters.

I claim:

1. Roofing system for industrial buildings characterized in that it comprises, in combination: a plurality of self-supporting tiles (10), prefabricated from reinforced concrete, displaying a generally "V"-shaped cross-section, wherein said "V"-shaped cross-section comprises two wings (11) which extend from a longitudinal channel (14), designed to collect rain water, in which said tile (10) ends, at its opposite ends, with respective closure heads (12), each provided with a support block (15), which is designed to rest on a supporting carrier beam (16), said support block (15) being furthermore provided with protruding parts (18) designed to support a corresponding block (15) of a superimposed identical tile (10), said tiles (10) being alternated with skylight-roofing beam members (20) and shed-roofing beam members (21).

2. Roofing system according to claim 1, characterized in that the wings (11) of said tiles (10) are externally provided with longitudinal contoured ribs (13) which get coupled inside respective complementary seats (19) provided in the roofing beam members (20) and (21).

3. Roofing system for industrial buildings characterized in that it comprises, in combination: a plurality of self-supporting tiles (10), prefabricated from reinforced concrete, displaying a generally "V"-shaped cross-section, wherein said "V"-shaped cross-section comprises two wings (11) which extend from a longitudinal channel (14), designed to collect rain water, in which said tile (10) ends, at its opposite ends, with respective closure heads (12), each provided with a support block (15), which is designed to rest on a supporting carrier beam (16), said support block (15) being furthermore provided with protruding parts (18) designed to support a corresponding block (15) of a superimposed identical tile (10), said tiles (10) being alternated with skylight-roofing beam members (20) and shed-roofing beam members (21), said tiles (10) resting on "H"-shaped carrier beams inside which rain water is conveyed, which is collected by said longitudinal channel (14).

4. Roofing system for industrial buildings characterized in that it comprises, in combination: a plurality of self-supporting tiles (10), prefabricated from reinforced concrete, displaying a generally "V"-shaped cross-section, wherein said "V"-shaped cross-section comprises two wings (11) which extend from a longitudinal channel (14), designed to collect rain water, in which said tile (10) ends, at its opposite ends, with respective closure heads (12), each provided with a support block (15), which is designed to rest on a supporting carrier beam (16), said support block (15) being furthermore provided with protruding parts (18) designed to support a corresponding block (15) of a superimposed identical tile (10), said tiles (10) being alternated with skylight-roofing beam members (20) and shed-roofing beam members (21), said tiles (10) having an additional central rib (25) provided in order to vary the span of said tile.

* * * * *